US008474265B2

(12) United States Patent
Jain et al.

(10) Patent No.: US 8,474,265 B2
(45) Date of Patent: Jul. 2, 2013

(54) FUEL NOZZLE FOR A TURBINE COMBUSTOR, AND METHODS OF FORMING SAME

(75) Inventors: Praveen Babulal Jain, Bangalore (IN); Narayan Subramanian, Mumbai (IN)

(73) Assignee: General Electric Company, Schenectady, NY (US)

( * ) Notice: Subject to any disclaimer, the term of this patent is extended or adjusted under 35 U.S.C. 154(b) by 1007 days.

(21) Appl. No.: 12/511,102

(22) Filed: Jul. 29, 2009

(65) Prior Publication Data

US 2011/0023493 A1 Feb. 3, 2011

(51) Int. Cl.
*F02C 1/00* (2006.01)
*F02C 7/24* (2006.01)

(52) U.S. Cl.
USPC ..... 60/742; 60/725; 60/737; 60/746

(58) Field of Classification Search
USPC ..... 60/734, 737, 740, 742, 746, 747, 60/748
See application file for complete search history.

(56) References Cited

U.S. PATENT DOCUMENTS

| | | | | |
|---|---|---|---|---|
| 5,431,018 | A | 7/1995 | Keller | |
| 5,685,157 | A | 11/1997 | Pandalai et al. | |
| 5,826,423 | A * | 10/1998 | Lockyer et al. | 60/39.463 |
| 6,073,479 | A | 6/2000 | Shapiro et al. | |
| 6,820,431 | B2 | 11/2004 | McManus et al. | |
| 7,320,222 | B2 | 1/2008 | Flohr et al. | |
| 2005/0223713 | A1 | 10/2005 | Ziminsky et al. | |
| 2006/0000220 | A1 | 1/2006 | Sattinger | |
| 2006/0059913 | A1 | 3/2006 | Bethke et al. | |
| 2007/0169992 | A1 | 7/2007 | Wasif et al. | |

FOREIGN PATENT DOCUMENTS

EP 1010939 6/2000

* cited by examiner

*Primary Examiner* — Ehud Gartenberg
*Assistant Examiner* — Arun Goyal
(74) *Attorney, Agent, or Firm* — Nixon & Vanderhye P.C.

(57) ABSTRACT

A fuel nozzle for a turbine engine includes a primary fuel passageway for supplying fuel to a plurality of radially extending fuel injectors arranged around the exterior of the fuel nozzle. A secondary fuel passageway couples an upstream end of the primary fuel passageway to a downstream end of the primary fuel passageway. The secondary fuel passageway acts as a resonator tube to help reduce oscillations in the fuel flowing through the primary fuel passageway.

20 Claims, 11 Drawing Sheets

FUEL NOZZLE FOR A TURBINE COMBUSTOR, AND METHODS OF FORMING SAME

BACKGROUND OF THE INVENTION

The invention relates to the design of a fuel nozzle used in a turbine engine.

In a typical turbine engine, a combustor receives compressed air from a compressor section of the turbine engine. Fuel is mixed with the compressed air in the combustor and the fuel-air mixture is then ignited to produce hot combustion gases. The hot combustion gases are routed to the turbine stage of the engine. Typically, a plurality of fuel nozzles are used to deliver fuel into the flow of compressed air within the combustor.

A traditional fuel nozzle is cylindrical in shape, with a cylindrical exterior wall. A plurality of radially extending fuel injectors are attached around a circumference of the exterior wall of the fuel nozzle. At least one fuel delivery port is formed on each of the fuel injectors.

A fuel delivery line is attached to an upstream end of the fuel nozzle. The fuel is typically delivered into an annular shaped primary fuel passageway formed on an inside of the fuel nozzle. The primary fuel passageway delivers fuel to the fuel injectors, and the fuel is ejected out of the fuel delivery ports of the fuel injectors so that it can mix with the compressed air running down the length of the fuel nozzle.

The fuel-air mixture created by the fuel nozzle is then ignited downstream from the fuel nozzle at a location within the combustor. The hot combustion gasses are then routed out of the combustor and into the turbine section of the engine.

Within the combustor, small oscillations in the fuel-air mixture lead to flame oscillations. The flame oscillations in turn generate pressure waves inside the combustor. The pressure waves can travel back to the fuel nozzle to cause a further oscillation in the delivery of additional fuel into the combustor. The interaction between the original oscillations and the further oscillations in the delivery of more fuel can be constructive or destructive. When the interaction is constructive, the oscillations can reinforce one another, resulting in large pressure oscillations within the combustor.

The pressure waves/oscillations, generally referred to as "combustion dynamics," can be strong enough to physically damage elements located within the combustor. Certainly, they increase the mechanical load on the walls of the combustor. They can also cause incomplete or inefficient combustion of the air-fuel mixture, which can increase undesirable $NO_x$ emissions. Further, the oscillations can cause flame flashback and/or flame blowout.

BRIEF DESCRIPTION OF THE INVENTION

In one aspect, the invention may be embodied in a fuel nozzle for a turbine engine that includes an exterior wall, and a plurality of radially extending fuel injectors formed on the exterior wall, where at least one fuel delivery port is formed on each fuel injector. The fuel nozzle may include a generally annular shaped primary fuel passageway formed inside the exterior wall and configured to deliver fuel to the fuel injectors. The fuel nozzle may further include a secondary fuel passageway located closer to a central longitudinal axis of the fuel nozzle than the primary fuel passageway, wherein the secondary fuel passageway receives fuel from a first portion of the primary fuel passageway and delivers fuel back into a second portion of the primary fuel passageway.

In another aspect, the invention may be embodied in a fuel nozzle for a turbine engine that includes an exterior wall, and a plurality of radially extending fuel injectors formed on the exterior wall, where at least one fuel delivery port is formed on each fuel injector. The fuel nozzle may also include a plurality of primary fuel passageways that extend down a length of the nozzle, wherein the primary fuel passageways are positioned along an inner surface of the exterior wall, and wherein the primary fuel passageways deliver fuel to the fuel injectors. The fuel injector may also include a plurality of secondary fuel passageways, wherein each secondary fuel passageway is located closer to a central longitudinal axis of the fuel nozzle than the primary fuel passageways, and wherein each secondary fuel passageway receives fuel from a first portion of a corresponding primary fuel passageway and delivers fuel back into a second portion of its corresponding primary fuel passageway.

In yet another aspect, the invention may be embodied in a method of forming a fuel nozzle for a turbine engine that includes forming a plurality of radially extending fuel injectors on an exterior wall, where at least one fuel delivery port is formed on each fuel injector, and forming at least one primary fuel passageway inside the exterior wall, wherein the at least one primary fuel passageway delivers fuel to at least one of the fuel injectors. The method may further include forming at least one secondary fuel passageway on a portion of the fuel nozzle that is located closer to a central longitudinal axis of the fuel nozzle than a corresponding primary fuel passageway, wherein each at least one secondary fuel passageway receives fuel from a first portion of a corresponding primary fuel passageway and delivers fuel back into a second portion of the corresponding primary fuel passageway.

DETAILED DESCRIPTION OF THE INVENTION

Figure 1:
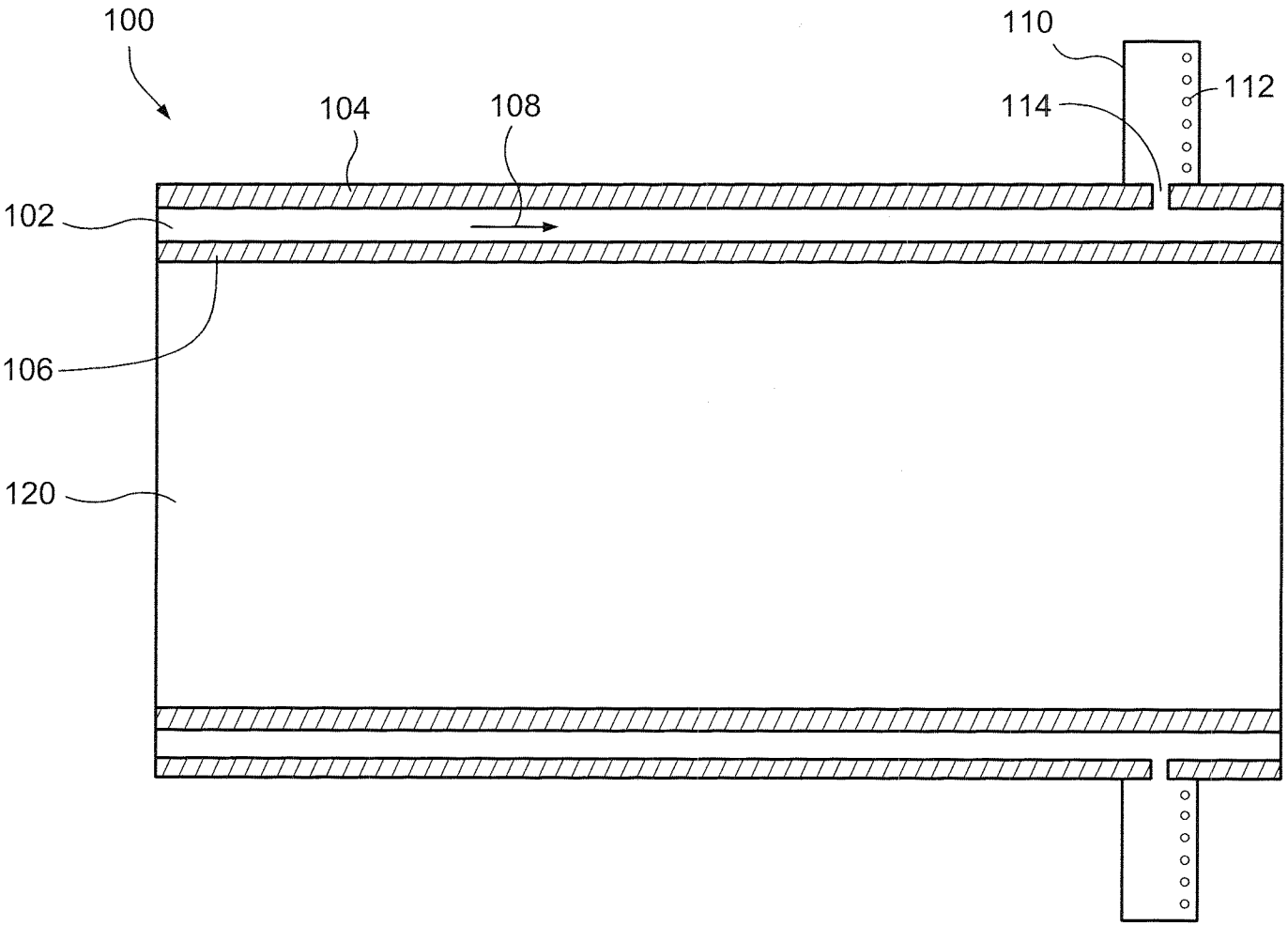
FIG. 1 is a longitudinal cross section of a typical fuel nozzle.

Some elements of a typical fuel nozzle design are illustrated in FIG. 1. As shown therein, the fuel nozzle 100 includes an exterior wall 104. A plurality of radially extending fuel injectors 110 are mounted around the circumference of the exterior wall 104. One or more fuel ports 112 are formed along the length of each fuel injector 110.

Fuel is delivered from a fuel supply line into an annular primary fuel passageway 102. The fuel moves in the direction of arrow 108 along the length of the fuel nozzle 100. The fuel within the primary passageway 102 then enters each fuel injector 110 through an aperture 114 formed in the exterior wall 104. The fuel is delivered to each of the fuel ports 112 where the fuel exits the fuel injector and mixes with the surrounding air. Typically, a large volume of compressed air is passing along the exterior wall of the fuel injector and the compressed air is also moving in the same direction as arrow 108. As a result, the fuel exiting the fuel ports 112 on the fuel injectors 110 is rapidly mixed with the compressed air. In the case of a liquid fuel, the fuel will also be rapidly atomized and mixed with the surrounding compressed air. The fuel-air mixture would then travel further downstream of the nozzle to a location where it is burned.

Although not specifically illustrated in FIG. 1, a typical fuel nozzle can also include many additional fuel passageways that run down the central region 120 of the fuel nozzle. Likewise, many additional features, such as swirlers, can also be mounted on the exterior wall 104 of the fuel nozzle. Because the invention focuses on the fuel being delivered to the fuel ports 112 on the fuel injectors 110, these are the only elements that have been illustrated. It should be understood that any given embodiment of a fuel nozzle would likely include many additional features which are not illustrated in the Figures.

In addition, in the embodiments illustrated in the Figures of the application, the fuel nozzle are generally cylindrical in shape. However, a fuel nozzle embodying the invention could have many other exterior shapes. For instance, a fuel nozzle embodying the invention could have an oval, square, rectangular or other rectilinear cross-sectional shape.

As noted above, when a fuel nozzle as illustrated in FIG. 1 is mounted in a combustor, the fuel nozzle can experience or be subjected to oscillations and pressure waves which induce corresponding oscillations or pressure waves in the fuel flowing through the primary fuel passageway 102.

Figure 2:
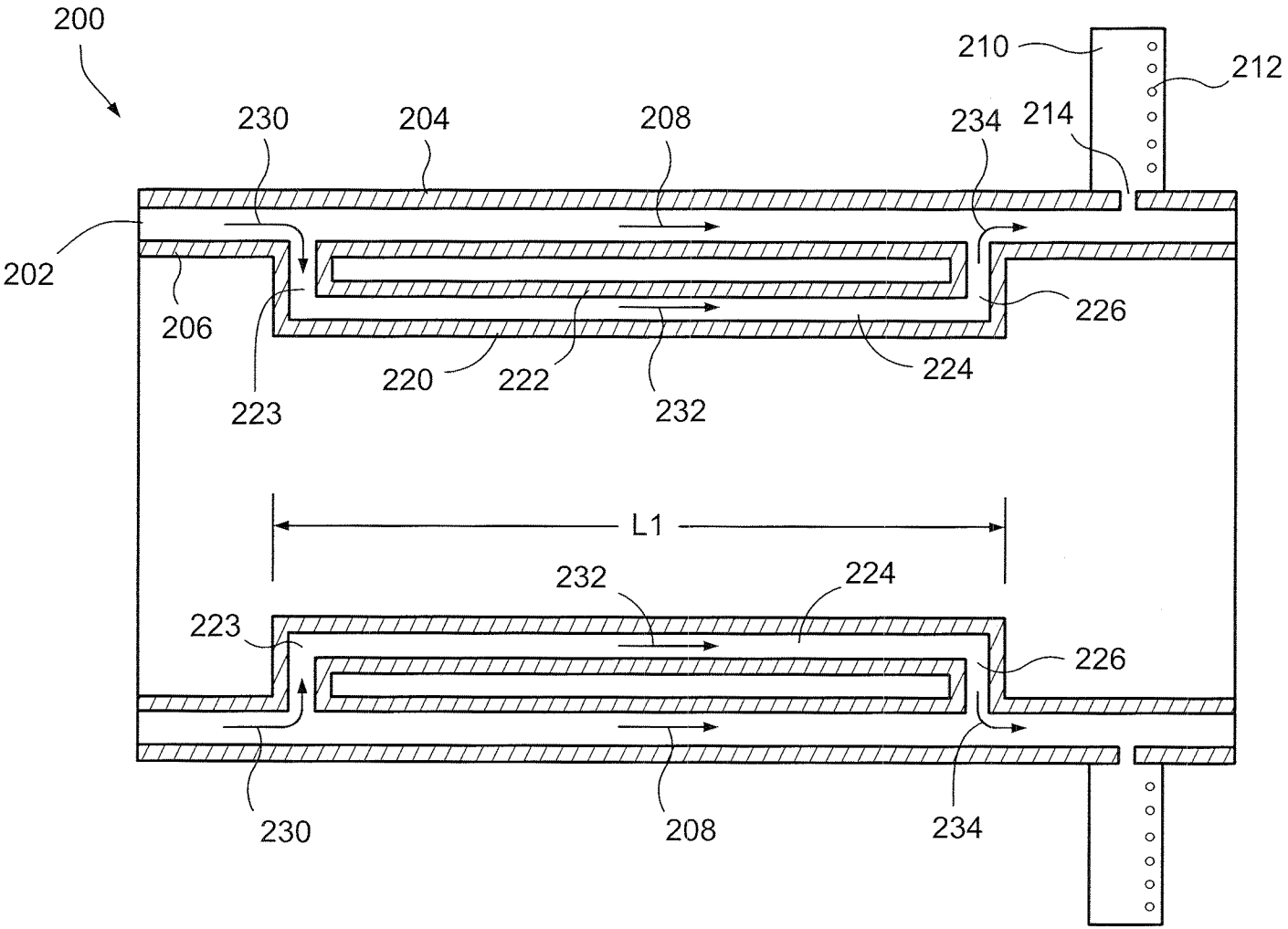
FIG. 2 is a longitudinal cross sectional view of an alternate fuel nozzle design which includes a secondary fuel passageway.

FIG. 2 illustrates a fuel nozzle which includes a secondary fuel passageway. As shown in FIG. 2, the secondary fuel passageway 224 is located inside of the primary fuel passageway 202. A first connecting passageway 223 couples an upstream end of the primary fuel passageway 202 to the upstream side of the secondary fuel passageway 224. In addition, a downstream connection passageway 226 couples the downstream end of the secondary fuel passageway 224 to the primary fuel passageway 202. As a result, fuel can pass down the primary fuel passageway as illustrated by arrow 208, and fuel can also pass through the secondary fuel passageway 224, as illustrated by arrows 230, 232 and 234. The fuel will then be delivered to the fuel injectors 210 as described above.

In the embodiment illustrated in FIG. 2, the secondary fuel passageway 224 is essentially concentric with the primary passageway 202. The concentric secondary fuel passageway 224 is formed by an inner wall 220 and an outer wall 222 which are located inside the fuel nozzle closer to a central longitudinal axis of the fuel nozzle than the primary fuel passageway 202.

The secondary fuel passageway 224 is configured to act as a resonator tube. When the secondary fuel passageway is formed with the proper dimensions, the provision of the secondary fuel passageway 224 can act to reduce or eliminate oscillations that are induced in the fuel flow via the fuel injectors. This, in turn, can reduce pressure oscillations within the combustion chamber, and transient oscillations in the downstream flame within the combustor. Reducing the flame and pressure oscillations improves the efficiency of the turbine engine, reduces undesirable emissions, avoids unexpected flashback and flameout, and can extend the life of the combustor hardware.

Figure 3:
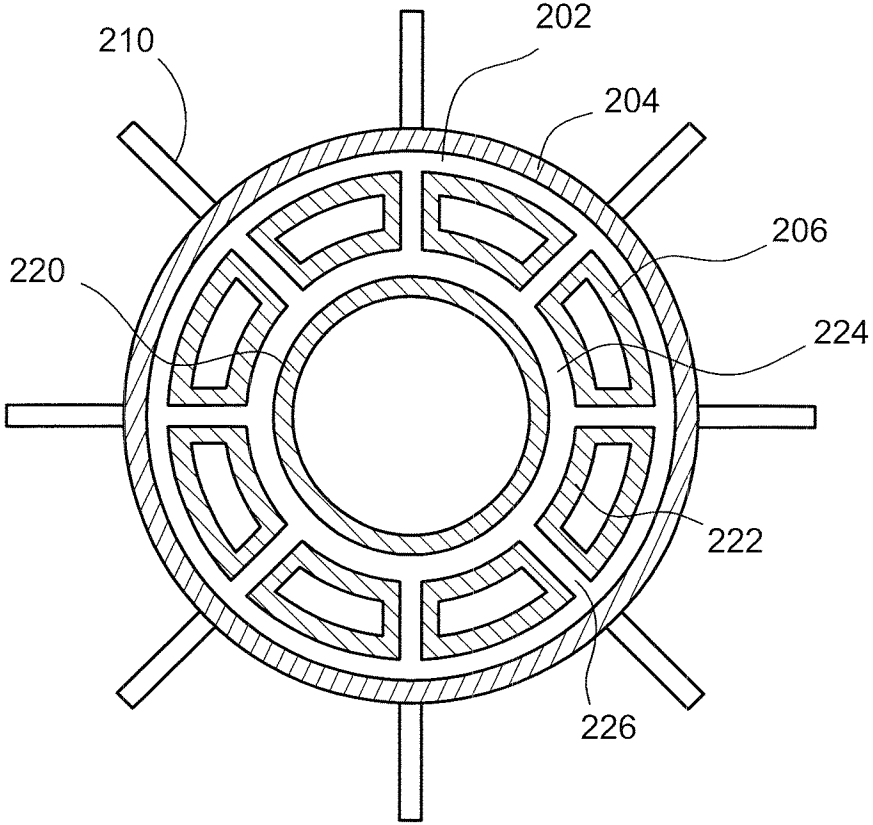
FIG. 3 is a cross sectional view of the fuel nozzle shown in FIG. 2.

FIG. 3 illustrates a cross sectional view of the nozzle design illustrated in FIG. 2. As shown therein, the primary fuel passageway 202 is essentially the annular space located between the exterior wall 204 and a first cylindrical interior wall 206. The secondary fuel passageway 224 is formed between an inner cylindrical wall 220 and an outer cylindrical wall 222.

A plurality of radially extending connection passageways 223 and 226 couple the primary fuel passageway 202 to the secondary fuel passageway 224. In the embodiment illustrated in FIGS. 2 and 3, there are eight upstream connection passageways 223 at the upstream end, and eight downstream connection passageways 226 at the downstream end of the secondary fuel passageway. The positions of these connection passageways may coincide with the locations of the radially extending fuel injectors 210, or the connection passageways may be deliberately configured so that they do not correspond to the locations of the fuel injectors 210. Also, in some embodiments, different numbers of connection passageways could be formed between the primary fuel passageway 202 and the secondary fuel passageway 224. Further, a first number of upstream connection passageways may be formed between the primary and secondary fuel passageways, while a second, different number of downstream connection passageways are provided.

As discussed above, the dimensions and configuration of the secondary fuel passageway and the upstream and downstream connection passageways can be selected to reduce oscillations in the fuel flow at selected frequencies. Thus, a designer can alter the dimensions and configuration of the secondary fuel passageway and connection passageways to help cancel or reduce oscillations at particular frequencies.

Figure 4:
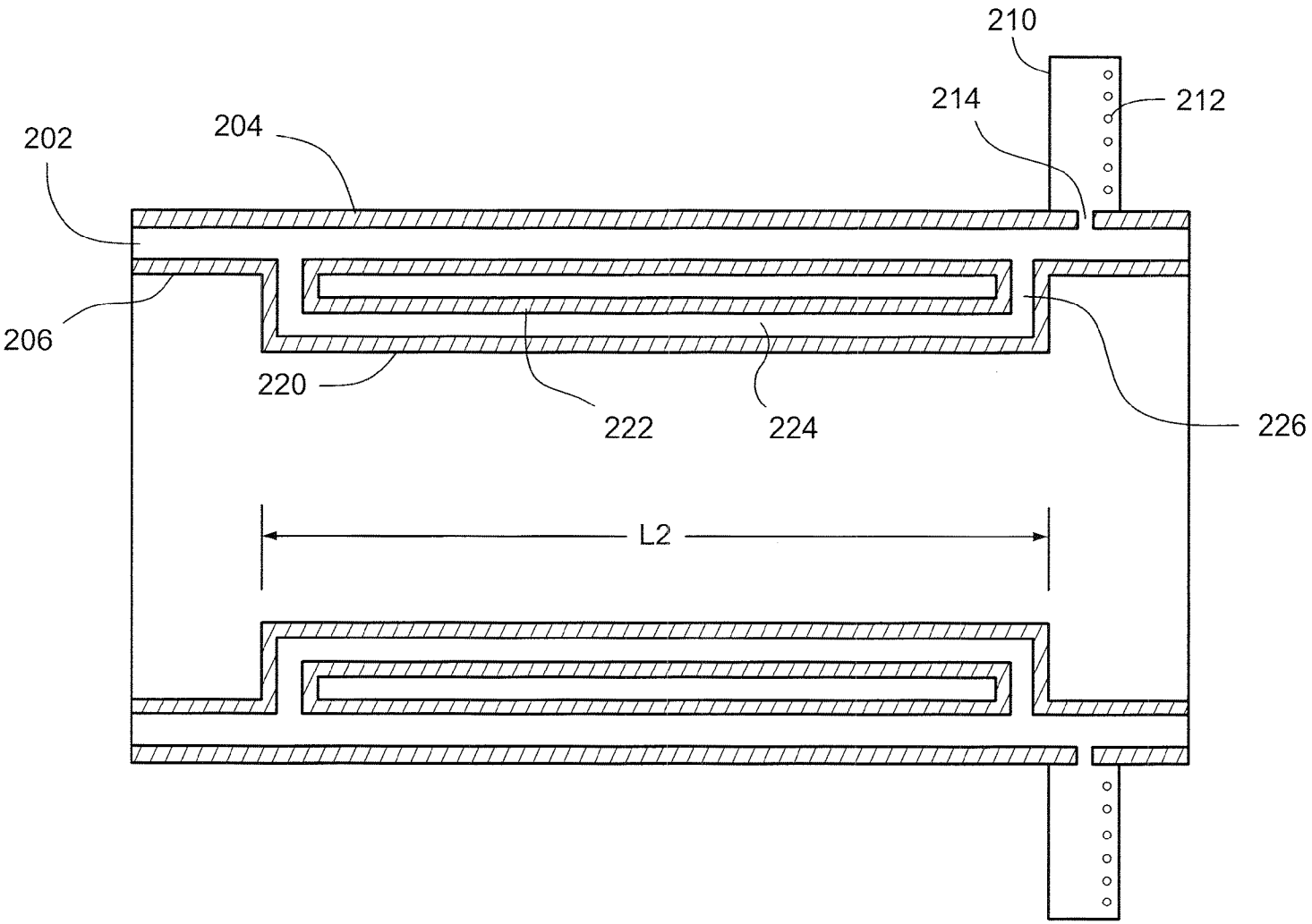
FIG. 4 is a longitudinal cross sectional view of an alternate fuel nozzle design that includes a secondary fuel passageway.

One way to alter or tune a fuel nozzle to reduce or eliminate oscillations at a selected frequency is to alter the length of the secondary fuel passageway. FIG. 2 illustrates a first embodiment wherein the secondary fuel passageway has a length L1. FIG. 4 illustrates an alternate embodiment of a fuel nozzle where the secondary fuel passageway has a length L2, which is greater than length L1 of the secondary fuel passageway in the embodiment shown in FIG. 2. A designer can selectively vary a length of the secondary fuel passageway to tune the fuel nozzle for particular characteristics.

Figure 5:
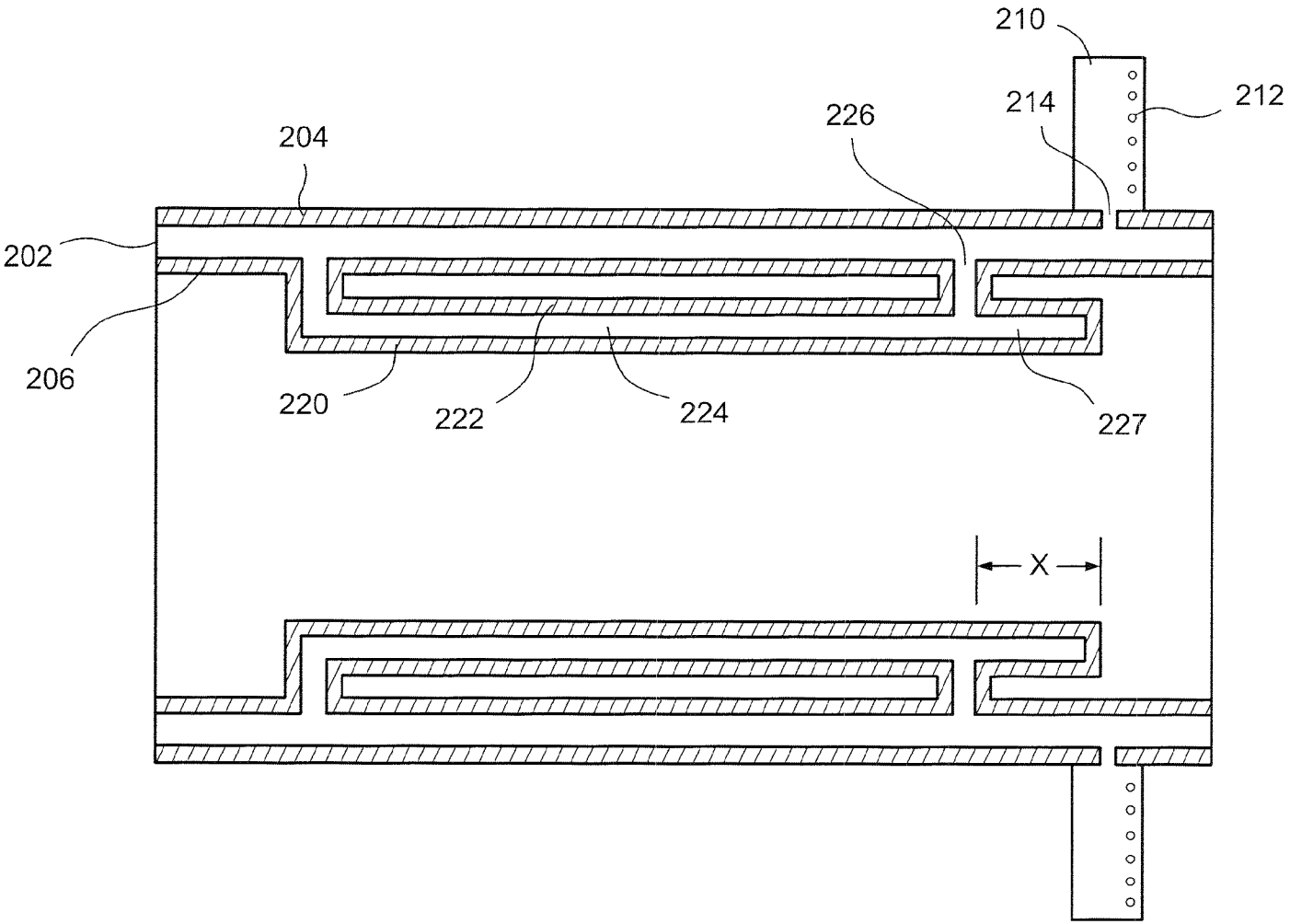
FIG. 5 is a longitudinal cross sectional view of another embodiment of a fuel nozzle.

Another way of tuning the fuel nozzle so that it will have certain characteristics is to alter the shape of the secondary fuel passageway. FIG. 5 shows an alternate embodiment of the fuel nozzle where the downstream connection passageway 226 couples an interim portion of the secondary fuel passageway 224 back to the primary fuel passageway 202. Note that a further downstream portion 227 of the secondary fuel passageway is simply closed off. By varying the length X between the downstream connection passageway 226 and the downstream end of the secondary fuel passageway 224 one can tailor the fuel nozzle so that it includes certain characteristics.

Figure 6:
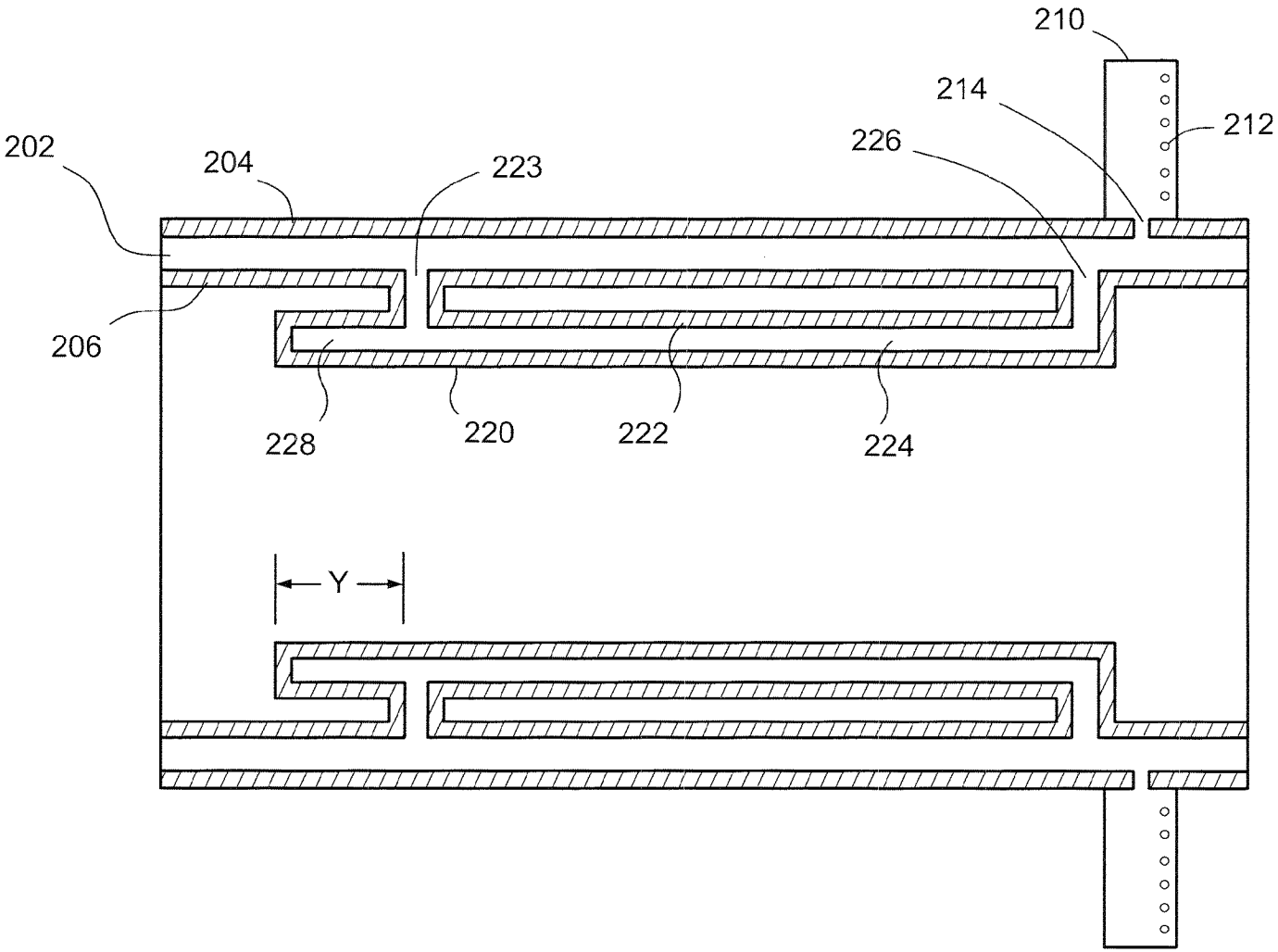
FIG. 6 is a longitudinal cross sectional view of another embodiment of a fuel nozzle.

An alternate embodiment of the fuel nozzle similar to the one shown in FIG. 5 is illustrated in FIG. 6. In this embodiment, the upstream connection passageway 223 couples the primary fuel passageway 202 to an interim portion of the secondary fuel passageway 224. An additional upstream length Y of the secondary fuel passageway 224 extends further upstream and is closed off. Here again, the shape and dimensions of the secondary fuel passageway 224 would be selected to give the fuel nozzle certain characteristics.

Figure 7:
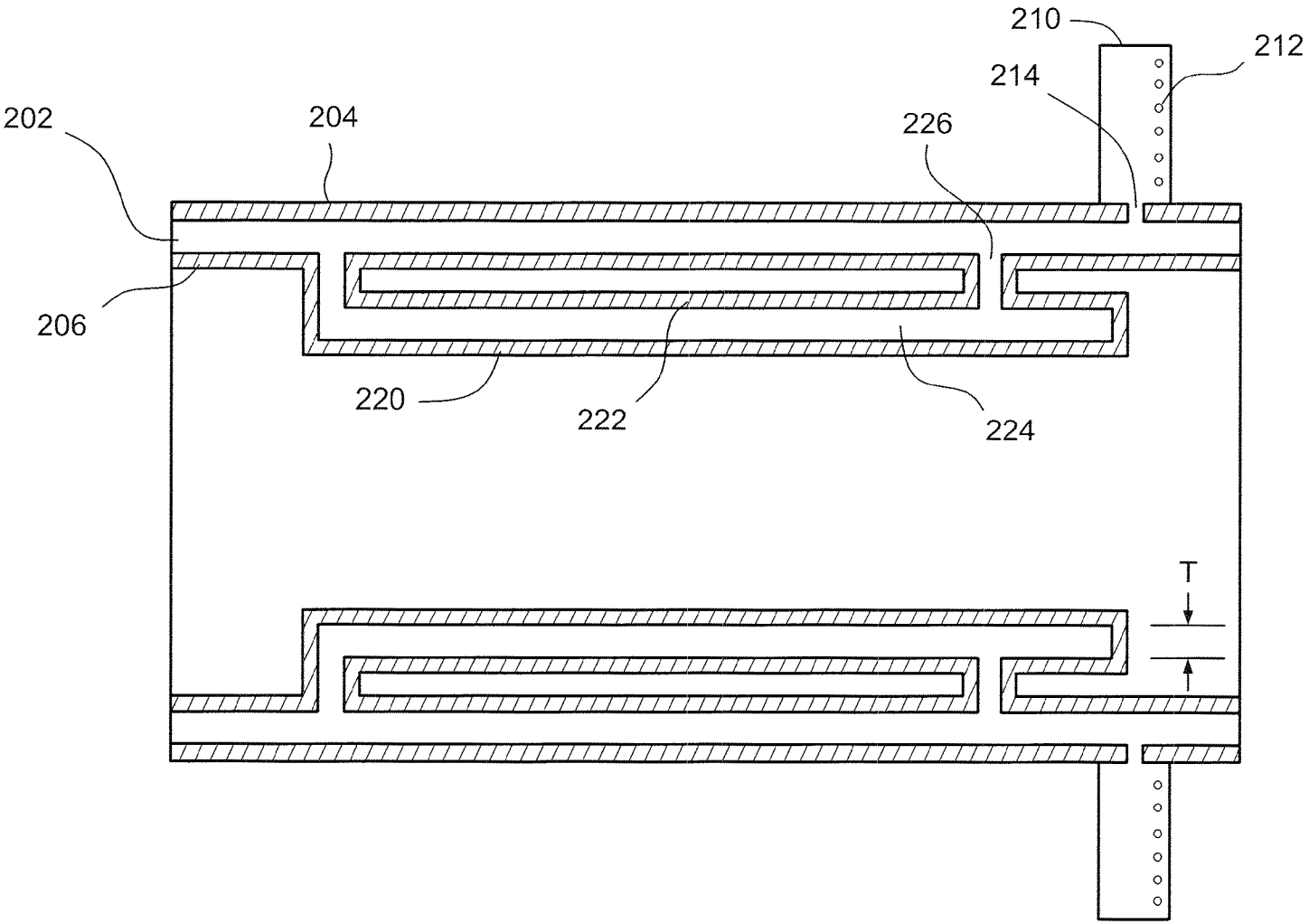
FIG. 7 is a longitudinal cross sectional view of another embodiment of a fuel nozzle.

FIG. 7 illustrates another way to tune a fuel nozzle so that it includes selected characteristics. In the fuel nozzle illustrated in FIG. 7, the thickness T of the secondary fuel passageway 224 is greater than the thickness of the secondary fuel passageway 224 of the embodiment shown in FIG. 5. All other characteristics of the embodiments as shown in FIGS. 5 and 7 are the same. By selectively varying the thickness of the secondary fuel passageway, one can alter the frequencies at which oscillations are reduced.

Figure 8:
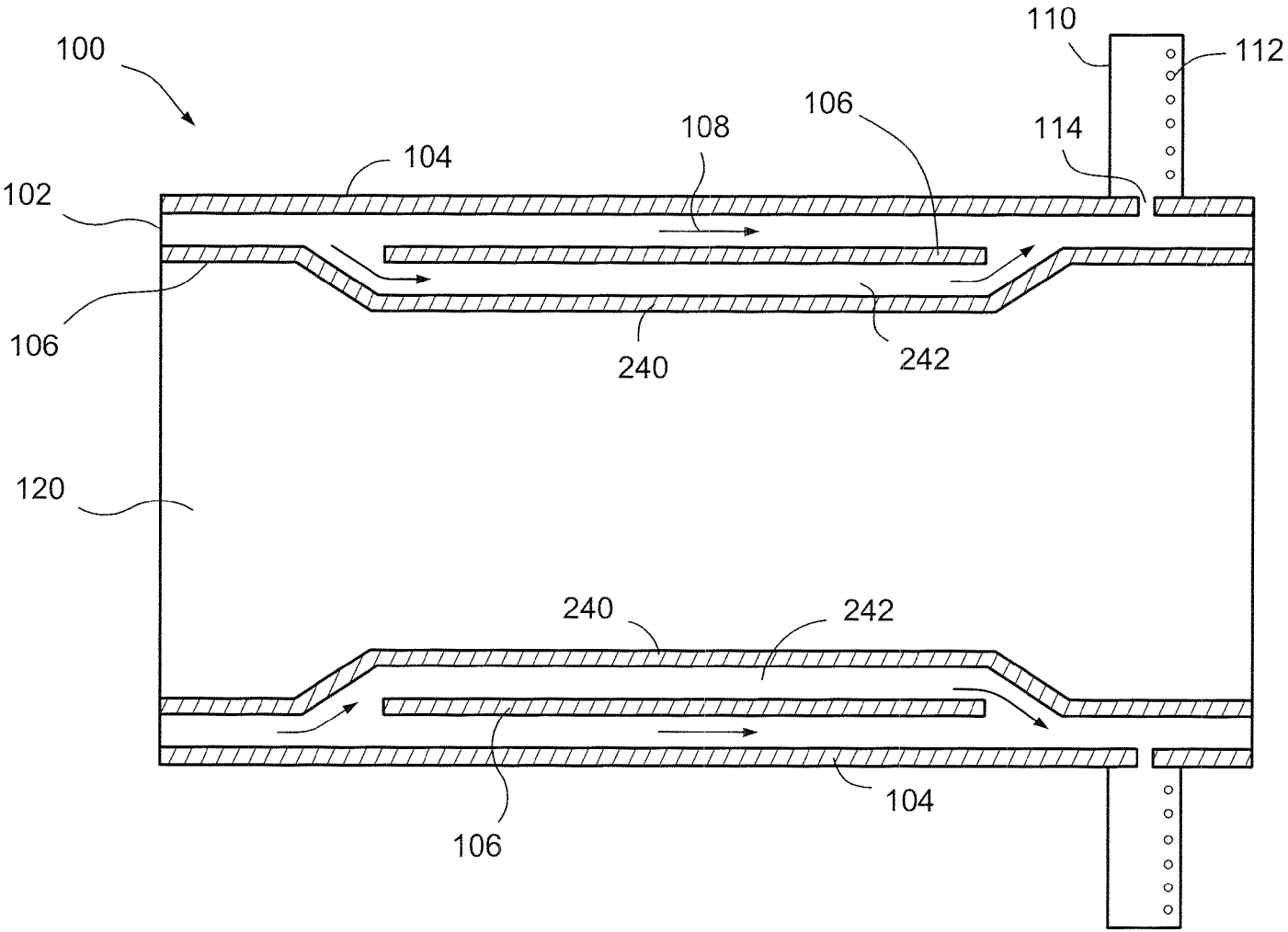
FIG. 8 is a longitudinal cross sectional view of another embodiment of a fuel nozzle.

In each of the embodiments illustrated in FIGS. 2-7, the inner and outer walls of the primary fuel passageway are completely separated from the inner and outer walls of the secondary fuel passageway. FIG. 8 illustrates an embodiment in which a single wall forms both the inner wall of a primary fuel passageway and the outer wall of a secondary fuel passageway.

As shown in FIG. 8, the outer wall of the primary fuel passageway 102 is still formed by the exterior wall 104 of the fuel nozzle. The inner wall 106 of the primary fuel passageway 102 also forms the outer wall of the secondary fuel passageway 242. Apertures in the wall 106 between the primary and secondary fuel passageways allow the secondary fuel passageway 242 to be connected to the primary fuel passageway 102.

In some embodiments, both the primary fuel passageway 102 and the secondary fuel passageway 242 would extend around the entire circumference of the fuel nozzle. This would mean that the primary fuel passageway and the secondary fuel passageway form concentric annular passages down the length of the fuel nozzle.

Figure 9:
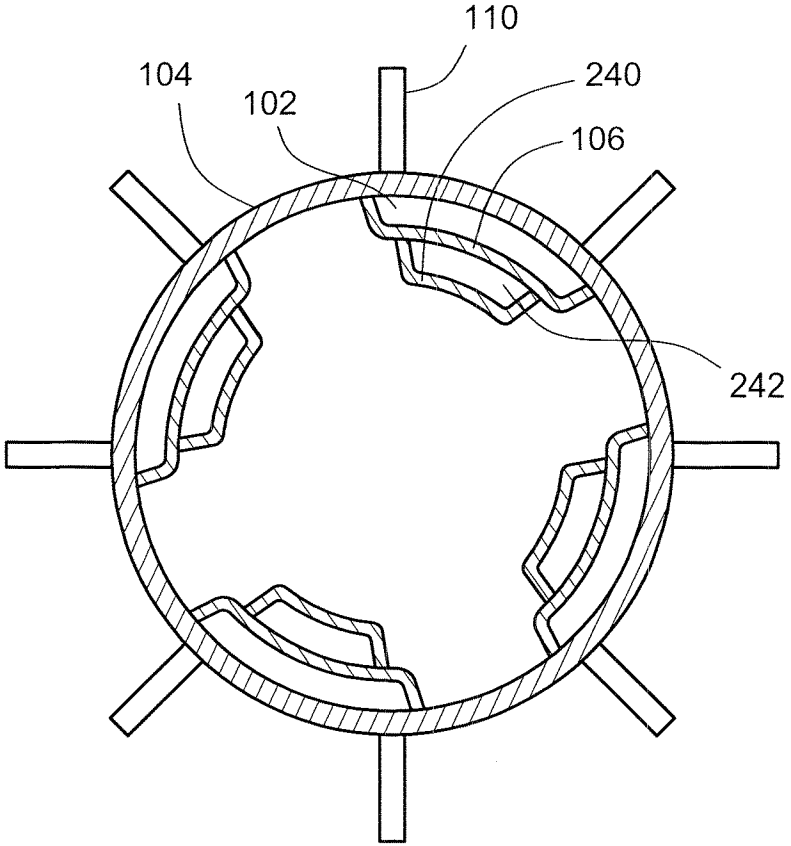
FIG. 9 is a cross sectional view of the fuel nozzle shown in FIG. 8.

In alternate embodiments, both the primary fuel passageway and the secondary fuel passageway can be formed as a plurality of individual passageways that extend down the inner sides of the fuel nozzle. FIG. 9 illustrates a cross sectional view of this type of an embodiment. As shown in FIG. 9, four separate primary fuel passageways 102 are spaced around the inner circumference of the exterior wall 104. Each primary fuel passageway 102 is formed by an inner wall 106 which extends down the length of the fuel nozzle. In addition, each primary fuel passageway 102 is connected to a corresponding secondary fuel passageway 242. The secondary fuel passageways 242 are formed by a plurality of inner walls 240 which are attached to the exterior sides of the inner walls 106 of the primary fuel passageways 102. Apertures through the inner walls 106 of the primary fuel passageways 102 connect the primary fuel passageways 102 to their corresponding secondary fuel passageways 242.

In the embodiment illustrated in FIG. 9, there are a total of eight fuel injectors 110 spaced around the exterior circumference of the fuel nozzle. In addition, each primary and corresponding secondary fuel passageways supply fuel to two of the fuel injectors 110. Thus, there are a total of four primary fuel passageways and four corresponding secondary fuel passageways.

In alternate embodiment, different numbers of fuel injectors 110, primary fuel passageways 102, and secondary fuel passageways could be provided. For instance, each fuel injector 110 might be supplied fuel by its own individual primary and secondary fuel passageway. Alternatively, a single primary and secondary fuel passageway could supply fuel to more than two fuel injectors 110. Moreover, as noted above, the length and configuration of the secondary fuel passageways 242 could be selectively varied to provide the fuel nozzle with selected characteristics.

Figure 10:
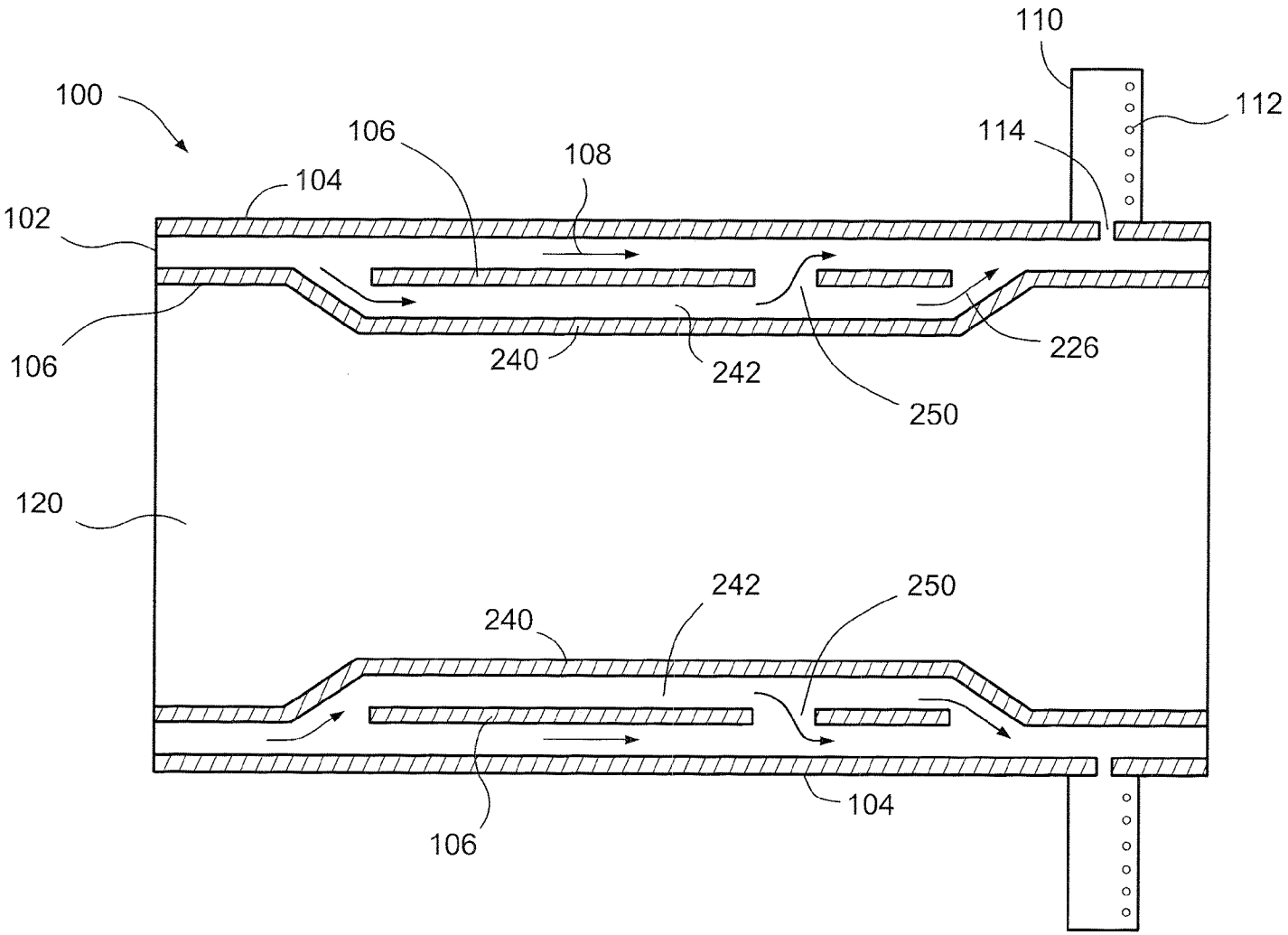
FIG. 10 is a longitudinal cross sectional view of another embodiment of a fuel nozzle.

Another way of tuning a fuel nozzle so that it has selected characteristic is illustrated in FIG. 10. As shown therein, in this embodiment there are a total of three connection passageways along the length of the secondary fuel passageway. An upstream connection passageway admits fuel from the primary passageway into the secondary fuel passageway. An interim connection passageway is located towards the downstream end of the secondary fuel passageway, and a final downstream connection passageway ensures that any fuel at the downstream end of the secondary fuel passageway is returned to the primary fuel passageway.

In still other embodiments, additional connection passageways or apertures located between the primary and secondary fuel passageways could be provided to tune the fuel nozzle so that it has certain characteristics.

Figure 11:
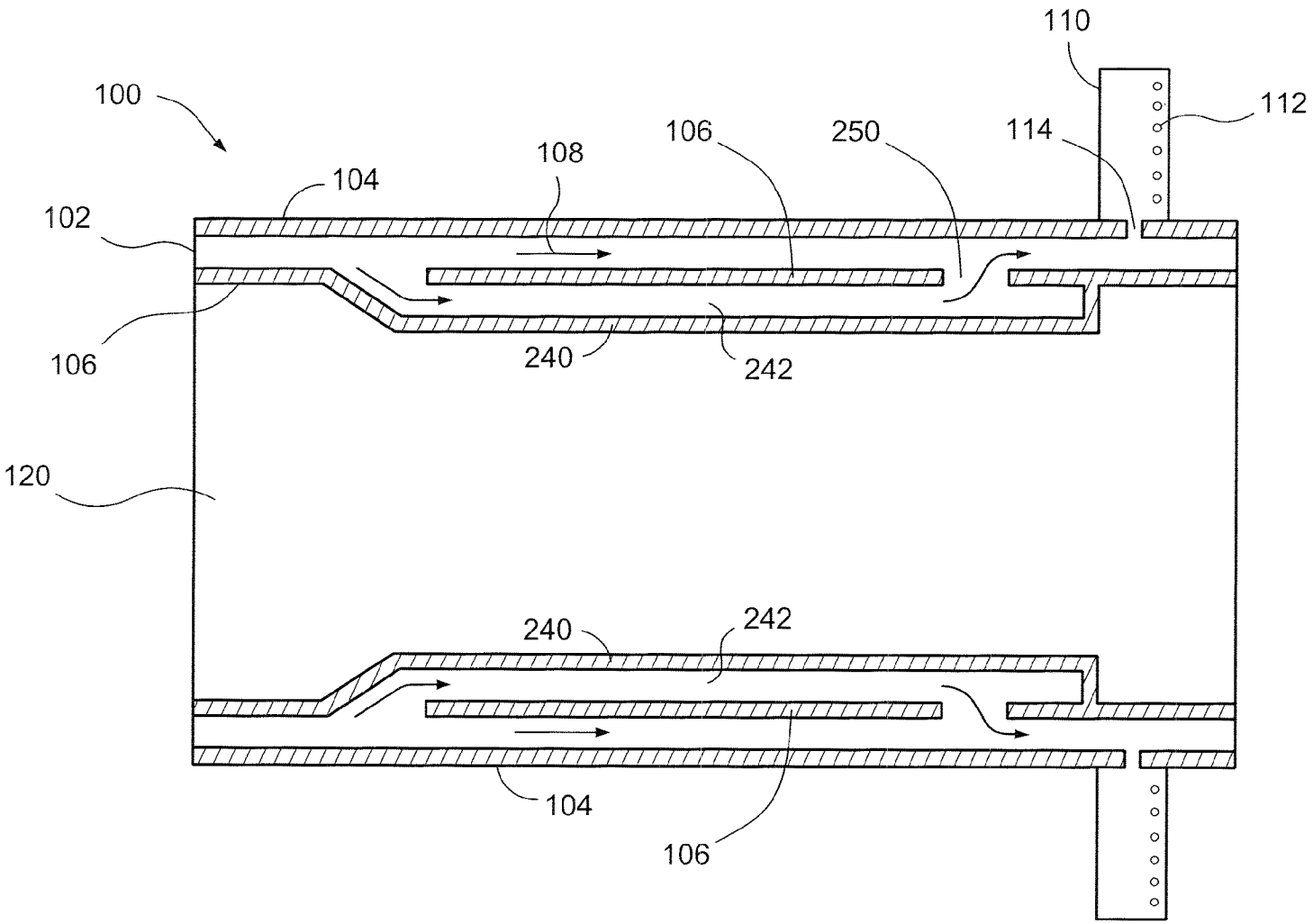
FIG. 11 is a longitudinal cross sectional view of yet another embodiment of a fuel nozzle.

FIG. 11 illustrates yet another alternate embodiment of a fuel nozzle. As shown in FIG. 11, the downstream ends of the secondary fuel passageway 242 are closed off, and an interim connection passageway 250 couples an interim portion of a secondary fuel passageway 242 to the primary fuel passageway 102. Here again, the configuration of the secondary fuel passageway has been altered to give the fuel nozzle certain characteristics.

In still other embodiments of the invention, the primary or secondary fuel passageways, and/or the connection passageways may include portions that are formed of a flexible material, such as an elastic material. The elastic material may further serve to dampen oscillations in the fuel flow.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A fuel nozzle for a turbine engine, comprising:

an exterior wall;

a plurality of radially extending fuel injectors formed on the exterior wall and extending outward away from the exterior wall, where at least one fuel delivery port is formed on each fuel injector;

a generally annular shaped primary fuel passageway formed inside the exterior wall and configured to deliver fuel to the fuel injectors; and a secondary fuel passageway located closer to a central longitudinal axis of the fuel nozzle than the primary fuel passageway, wherein the secondary fuel passageway receives fuel from a first portion of the primary fuel passageway and delivers fuel back into a second portion of the primary fuel passageway at a location that is downstream from the first portion and upstream of the radially extending fuel injectors.

2. The fuel nozzle of claim 1, wherein the secondary fuel passageway is also generally annular shaped.

3. The fuel nozzle of claim 2, wherein the primary fuel passageway and the secondary fuel passageway are concentric.

4. The fuel nozzle of claim 3, wherein a plurality of radially extending connection passageways connect the primary fuel passageway and the secondary fuel passageway.

5. The fuel nozzle of claim 4, wherein a set of inlet connection passageways connect the first portion of the primary fuel passageway to an upstream end of the secondary fuel passageway, and wherein a set of outlet connection passageways connect the second portion of the primary fuel passageway to a downstream end of the secondary fuel passageway.

6. The fuel nozzle of claim 4, wherein a set of inlet connection passageways connect the first portion of the primary fuel passageway to an upstream end of the secondary fuel passageway, and wherein a set of outlet connection passageways connect the second portion of the primary fuel passageway to an interim position along a length of the secondary fuel passageway.

7. The fuel nozzle of claim 6, wherein a downstream end of the secondary fuel passageway is closed off.

8. The fuel nozzle of claim 4, wherein a set of inlet connection passageways connect the first portion of the primary fuel passageway to an interim position along a length of the secondary fuel passageway, and wherein a set of outlet connection passageways connect the second portion of the primary fuel passageway to a downstream end of the secondary fuel passageway.

9. The fuel nozzle of claim 8, wherein an upstream end of the secondary fuel passageway is closed off.

10. A fuel nozzle for a turbine engine, comprising:

an exterior wall;

a plurality of radially extending fuel injectors formed on the exterior wall and extending outward away from the exterior wall, where at least one fuel delivery port is formed on each fuel injector;

a plurality of primary fuel passageways that extend down a length of the nozzle, wherein the primary fuel passageways are positioned along an inner side of the exterior wall, and wherein the primary fuel passageways deliver fuel to the fuel injectors; and a plurality of secondary fuel passageways, wherein each secondary fuel passageway is located closer to a central longitudinal axis of the fuel nozzle than the primary fuel passageways, and wherein each secondary fuel passageway receives fuel from a first portion of a corresponding primary fuel passageway and delivers fuel back into a second portion of its corresponding primary fuel passageway at a location that is downstream from the first portion and upstream of the radially extending fuel injectors.

11. The fuel nozzle of claim 10, wherein a single primary fuel passageway delivers fuel to a plurality of fuel injectors.

12. The fuel nozzle of claim 10, wherein the exterior wall forms the outer wall of the primary fuel passageways.

13. The fuel nozzle of claim 12, wherein an inner wall of each primary fuel passageway also forms the outer wall of a corresponding secondary fuel passageway.

14. The fuel nozzle of claim 13, wherein openings in the inner wall of each primary fuel passageway connect the primary fuel passageway to its corresponding secondary fuel passageway.

15. The fuel nozzle of claim 13, wherein an upstream opening in the inner wall of each primary fuel passageway allows fuel from the first portion of the primary fuel passageway to flow into the corresponding secondary fuel passageway, and wherein a downstream opening in the inner wall of each primary fuel passageway allows fuel in the corresponding secondary fuel passageway to flow into the second portion of the primary fuel passageway.

16. A method of forming a fuel nozzle for a turbine engine, comprising:

forming a plurality of radially extending fuel injectors that extend outward from an exterior wall, where at least one fuel delivery port is formed on each fuel injector;

forming at least one primary fuel passageway along an inner side of the exterior wall, wherein the at least one primary fuel passageway delivers fuel to at least one of the fuel injectors; and forming at least one secondary fuel passageway on a portion of the fuel nozzle that is located closer to a central longitudinal axis of the fuel nozzle than a corresponding primary fuel passageway, wherein each at least one secondary fuel passageway receives fuel from a first portion of a corresponding primary fuel passageway and delivers fuel back into a second portion of the corresponding primary fuel passageway at a location that is downstream from the first portion and upstream of the radially extending fuel injectors.

17. The method of claim 16, further comprising forming a plurality of connecting passageways that couple each at least one primary fuel passageway to a corresponding secondary fuel passageway.

18. The method of claim 17, wherein the connecting passageways are formed such that an upstream connecting passageway couples an upstream portion of each primary fuel passageway to a first portion of a corresponding secondary fuel passageway, and such that a downstream connecting passageway couples a downstream portion of each primary fuel passageway to a second portion of the corresponding secondary fuel passageway.

19. The method of claim 16, wherein the forming steps result in an inner wall of each primary fuel passageway forming an outer wall of a corresponding secondary fuel passageway.

20. The method of claim 19, further comprising forming apertures in the inner wall of each primary fuel passageway to couple the primary fuel passageway to upstream and downstream ends of the corresponding secondary fuel passageways.

* * * * *